US007452095B1

(12) United States Patent
Schnuckle

(10) Patent No.: US 7,452,095 B1
(45) Date of Patent: Nov. 18, 2008

(54) DEVICE AND METHOD FOR ILLUMINATING LIQUID DROPLETS

(75) Inventor: Gary W. Schnuckle, Altadena, CA (US)

(73) Assignee: Disney Enterprises, Inc., Burbank, CA (US)

( * ) Notice: Subject to any disclaimer, the term of this patent is extended or adjusted under 35 U.S.C. 154(b) by 106 days.

(21) Appl. No.: 11/606,304

(22) Filed: Nov. 27, 2006

(51) Int. Cl.
*F21V 33/00* (2006.01)

(52) U.S. Cl. ..... 362/101; 362/96; 362/806

(58) Field of Classification Search ..... 362/101, 362/96, 318, 125, 253, 259, 806, 800; 239/18; 40/441

See application file for complete search history.

(56) References Cited

U.S. PATENT DOCUMENTS 3,174,688 A * 3/1965 Chatten ..... 239/20
2008/0094821 A1* 4/2008 Vogtner ..... 362/101

* cited by examiner

*Primary Examiner*—Bao Q Truong
(74) *Attorney, Agent, or Firm*—Farjami & Farjami LLP

(57) ABSTRACT

There is provided a liquid droplet illumination device, which includes at least one liquid droplet traveling on a first surface. The liquid droplet can be distilled water and the first surface can be a ribbon of translucent material. The liquid droplet illumination device further includes at least one light beam that is offset from the first surface. For example, the at least one light beam can be a coherent beam of light, such as a laser beam. The at least one light beam interacts with the at least one liquid droplet as it travels on the first surface, thereby illuminating the at least one liquid droplet.

19 Claims, 6 Drawing Sheets

DEVICE AND METHOD FOR ILLUMINATING LIQUID DROPLETS

BACKGROUND OF THE INVENTION

1. Field of the Invention

The present invention relates generally to decorative displays. More particularly, the present invention relates to light displays including illuminated liquid droplets.

2. Background Art

Amusement parks and theme parks continuously strive to provide their patrons with more attractive and stunning decorative displays. Such a goal can be achieved by using light displays including illuminated liquid droplets, which can provide interesting and attractive visual effects. One conventional light display includes a fountain, which forms oil droplets that travel slowly along a wire. The conventional light display further includes a colored light source, which provides ambient light that illuminates the oil droplets as they travel along the wire.

However, the contrast provided by the oil droplets in the conventional light display can be undesirably low, consequently making the illumination of the oil droplets difficult to observe. Moreover, the oil used in the conventional light display can rapidly collect dirt and can undesirably coagulate, causing the fountain to malfunction. In addition, the oil used in the conventional light display can make the conventional light display difficult to clean and maintain.

Thus, there is a strong need in the art for a light display that includes illuminated liquid droplets which provide high contrast and which is simple to clean and maintain.

SUMMARY OF THE INVENTION

There is provided a device and method for illuminating liquid droplets, substantially as shown in and/or described in connection with at least one of the figures, as set forth more completely in the claims.

BRIEF DESCRIPTION OF THE DRAWINGS

The features and advantages of the present invention will become more readily apparent to those ordinarily skilled in the art after reviewing the following detailed description and accompanying drawings, wherein.

DETAILED DESCRIPTION OF THE INVENTION

Figure 1A:
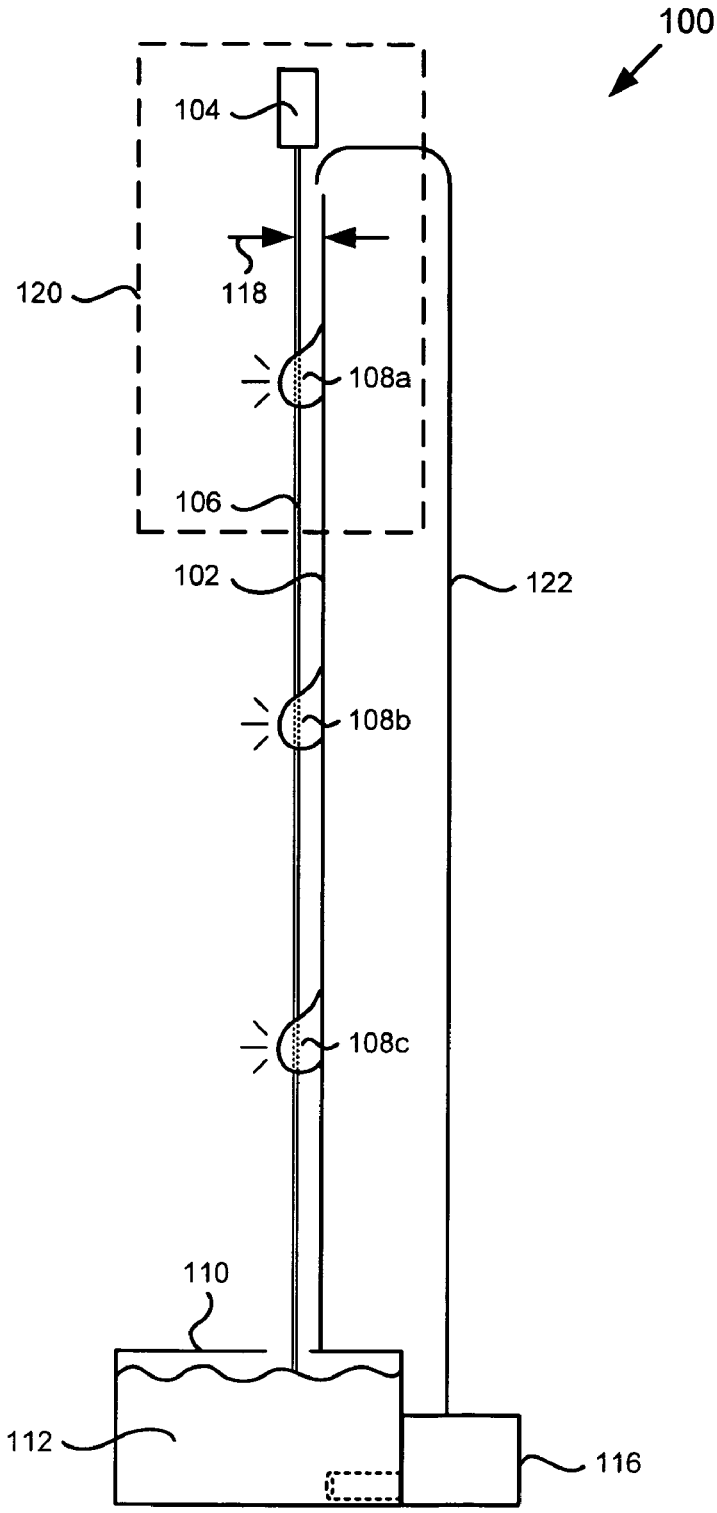
FIG. 1A illustrates a side view of a liquid droplet illumination device according to one embodiment of the present invention.

Although the invention is described with respect to specific embodiments, the principles of the invention, as defined by the claims appended herein, can obviously be applied beyond the specifically described embodiments of the invention described herein. Moreover, in the description of the present invention, certain details have been left out in order to not obscure the inventive aspects of the invention. The details left out are within the knowledge of a person of ordinary skill in the art.

The drawings in the present application and their accompanying detailed description are directed to merely example embodiments of the invention. To maintain brevity, other embodiments of the invention which use the principles of the present invention are not specifically described in the present application and are not specifically illustrated by the present drawings. It should be borne in mind that, unless noted otherwise, like or corresponding elements among the figures may be indicated by like or corresponding reference numerals.

FIG. 1A shows a side view of liquid droplet illumination device 100 in accordance with one embodiment of the present invention. Device 100 includes surface 102, light source 104, light beam 106, liquid reservoir 110 including liquid 112, and pump 116.

As shown in FIG. 1A, surface 102 is situated on liquid reservoir 110. Surface 102 can be, for example, a ribbon or strip of translucent material. In other embodiments, surface 102 can be a ribbon or strip of a reflective material, such as chrome colored graphic arts tape. Surface 102 can be positioned vertically as shown in FIG. 1A or can be tilted at various angles. As shown in FIG. 1A, liquid droplets, such as liquid droplets 108*a*, 108*b*, and 108*c*, can be formed on surface 102 and can comprise, for example, distilled water or other types of liquids. In the embodiment shown in FIG. 1A, gravity is used to cause liquid droplets 108*a*, 108*b*, and 108*c* to travel on surface 102 from the top of surface 102 down toward liquid reservoir 110, in which liquid droplets 108*a*, 108*b*, and 108*c* are collected. In other embodiments, other forces, such as forces created by moving air, can be used to cause liquid droplets to travel in an opposite direction. Moreover, device 100 may be encased or sealed in a translucent casing to protect device 100 from dirt and other unwanted particles.

As shown in FIG. 1A, liquid droplets 108*a*, 108*b*, and 108*c* can be formed by using a pump, such as pump 116, to move liquid 112 in liquid reservoir 110 to the top of surface 102 via tube 122. The flow rate of liquid 112 in tube 122 can be varied so as to form liquid droplets, such as liquid droplets 108*a*, 108*b*, and 108*c*, such that the liquid droplets are separated by a time interval. In other embodiments, liquid droplets 108*a*, 108*b*, and 108*c* can be formed without using a pump by providing a liquid source at or near the top of surface 102.

As also shown in FIG. 1A, light source 104 is situated above surface 102 and provides light beam 106. For example, light beam 106 can be a coherent beam of light, such as a laser beam, or a focused beam of light from a high intensity light emitting diode (LED). In one embodiment, light beam 106 can have a color, such as red, blue, or green. As further shown in FIG. 1A, light beam 106 is situated such that light beam 106 is offset from surface 102 by offset distance 118. For example, in one embodiment of the invention, offset distance 118 can be approximately one half the thickness of liquid droplets 108*a*, 108*b*, and 108*c*, such that light beam 106 passes through and interacts with liquid droplets 108*a*, 108*b*, and 108*c*, thereby illuminating liquid droplets 108*a*, 108*b*, and 108*c*. Although the embodiment of the invention shown in FIG. 1A includes only one light beam, additional light beams may be included.

Figure 1B:
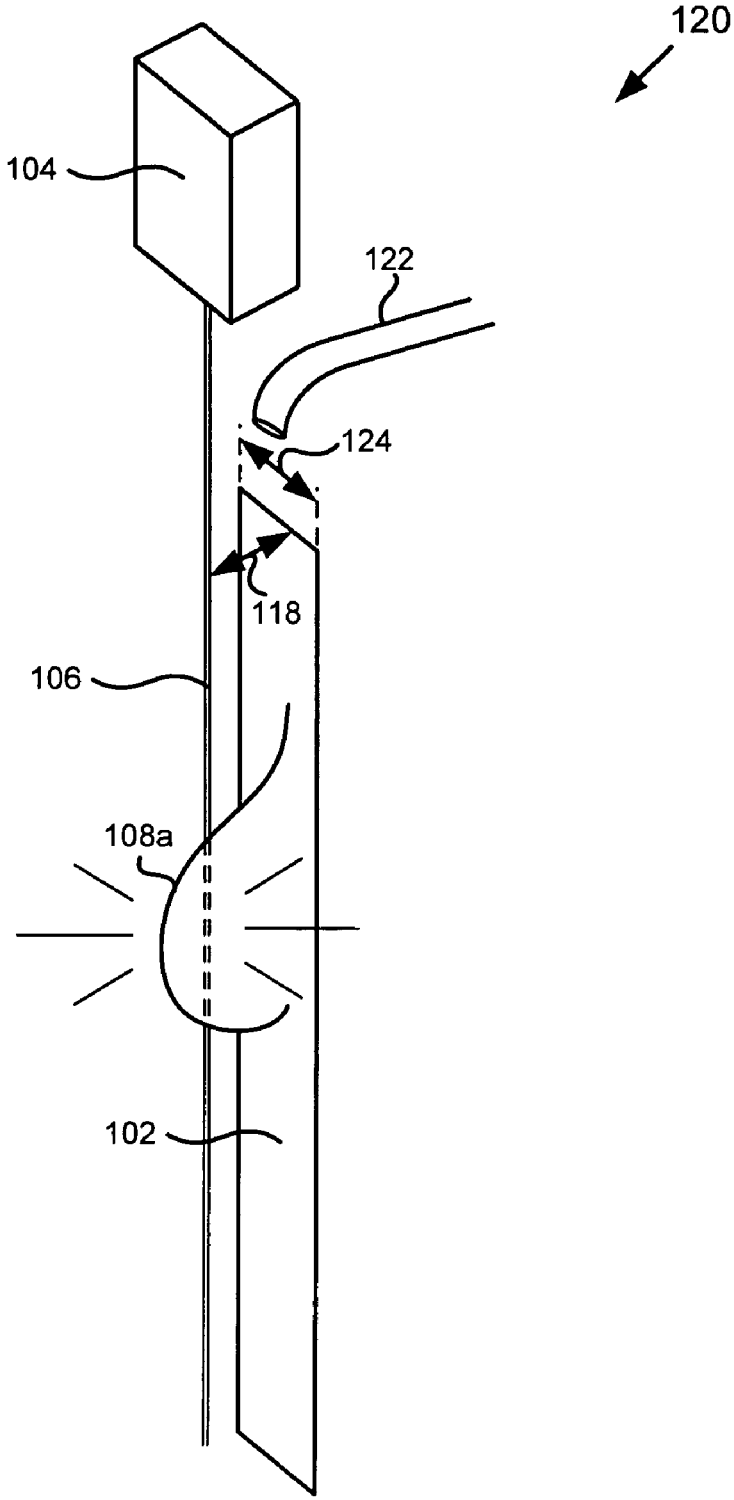
FIG. 1B illustrates an enlarged isometric view of a region of a liquid droplet illumination device.

FIG. 1B shows an enlarged isometric view of region 120 of device 100 in FIG. 1. In particular, surface 102, light source 104, light beam 106, liquid droplet 108*a*, and offset distance 118 correspond to the same elements in FIGS. 1A and 1B. Referring to FIG. 1B, region 120 includes surface 102, light source 104, light beam 106, liquid droplet 108*a*, offset distance 118, and surface width 124. As shown in FIG. 1B, surface 102 has surface width 124 which can be configured such that liquid droplet 108*a* remains on the desired side of surface 102 (e.g., the side facing light beam 106 so as to interact with light beam 106) and configured to achieve a desired velocity of liquid droplet 108*a* as it travels down surface 102. In other embodiments, surface 102 can be the inner surface of a cylinder, such as a tube, wherein liquid droplets 108*a*, 108*b*, and 108*c* travel down the inner surface of the tube while interacting with light beam 106.

Figure 2:
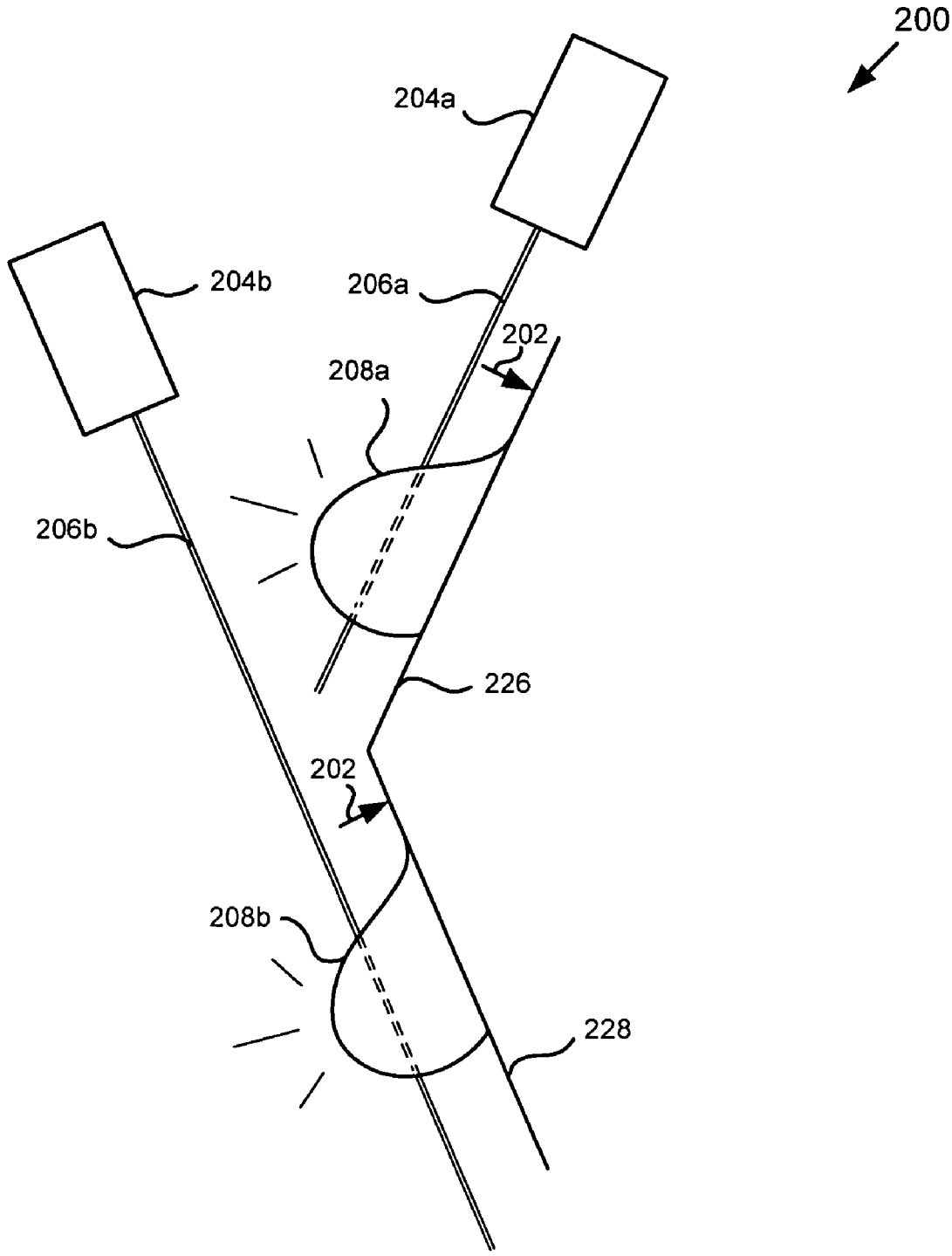
FIG. 2 illustrates a side view of a liquid droplet illumination device according to one embodiment of the present invention.

FIG. 2 shows a side view of liquid droplet illumination device 200 in accordance with one embodiment of the present invention. Device 200 includes surface 202, light sources 204*a* and 204*b*, light beams 206*a* and 206*b*, and liquid droplets 208*a* and 208*b*. In particular, surface 202 and liquid droplets 208*a* and 208*b* in FIG. 2 correspond to surface 102 and liquid droplets 108*a* and 108*b* in FIG. 1A, respectively. Light sources 204*a* and 204*b* in FIG. 2 correspond to light source 104 in FIG. 1A and light beams 206*a* and 206*b* correspond to light beam 106 in FIG. 1A.

As shown in FIG. 2, surface 202 can define various planes on which liquid droplets 208*a* and 208*b* can travel. For example, surface 202 defines one plane along segment 226 and another plane along segment 228. As shown in FIG. 2, light beams 206*a* and 206*b* are offset from surface 202 so as to interact with and illuminate liquid droplets 208*a* and 208*b* as they travel on surface 202. Moreover, each light beam can be oriented in a direction that is substantially parallel to a plane defined by surface 202. In FIG. 2 for example, light beam 206*b* is oriented in a direction that is substantially parallel to the plane defined by surface 202 along segment 228.

Therefore, the example embodiment shown in FIG. 2 allows liquid droplets 208*a* and 208*b* to interact with a light beam and remain illuminated while traveling along various planes defined by surface 202. For example, liquid droplet 208*a* can interact with light beam 206*a* while traveling along segment 226 of surface 202 and can interact with light beam 206*b* while traveling along segment 228 of surface 202. In one embodiment, light beams 206*a* and 206*b* can be a single color and can be constantly on. In other embodiments, light beams 206*a* and 206*b* can be different in color and may come on and off periodically as the liquid droplets travel on surface 202.

Figure 3:
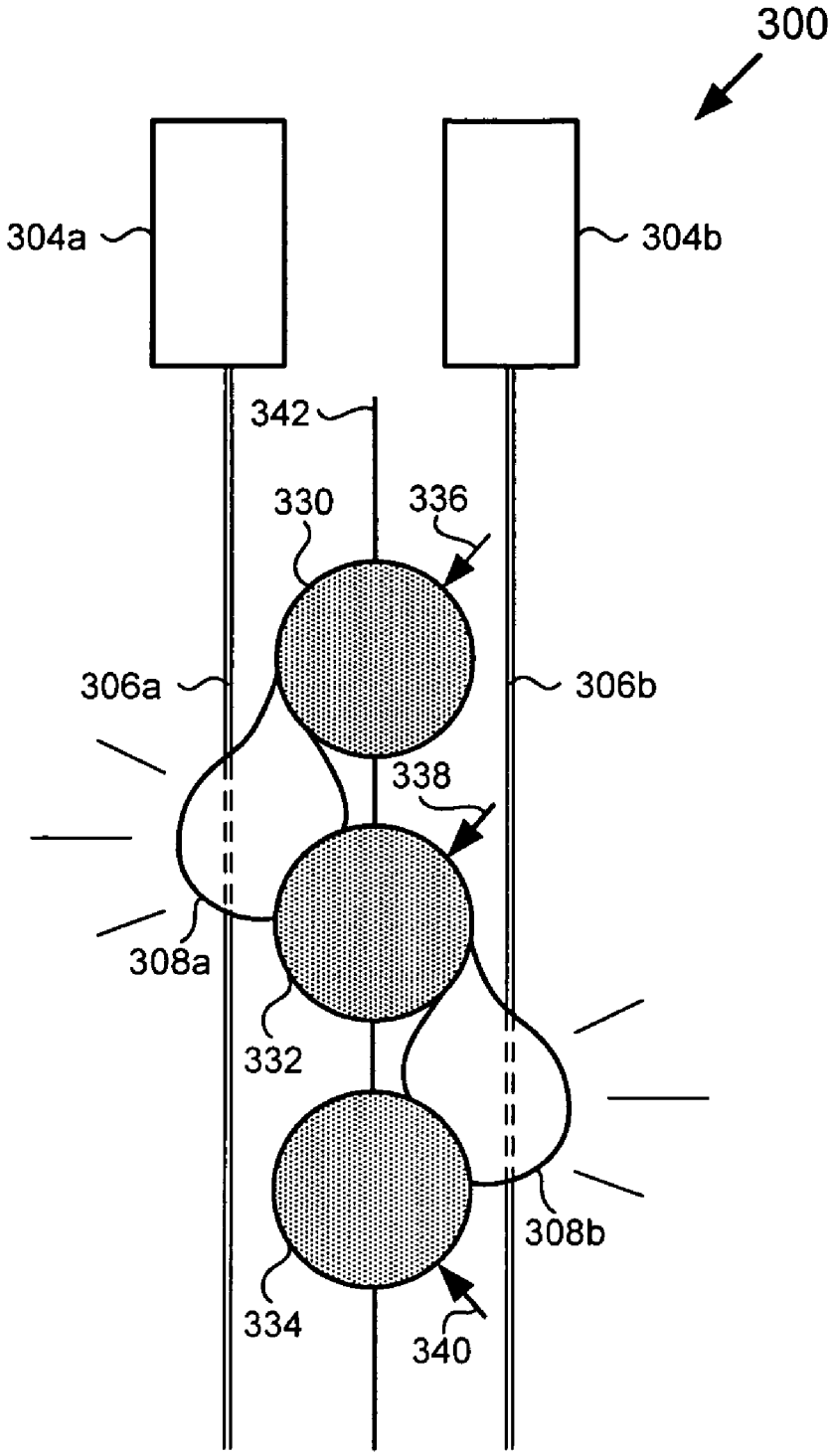
FIG. 3 illustrates a side view of a liquid droplet illumination device according to one embodiment of the present invention.

FIG. 3 shows a liquid droplet illumination device in accordance with one embodiment of the present invention. Device 300 includes beads 330, 332, and 334, light sources 304*a* and 304*b*, light beams 306*a* and 306*b*, and liquid droplets 308*a* and 308*b*. In particular, liquid droplets 308*a* and 308*b* correspond to liquid droplets 108*a* and 108*b* in FIG. 1, respectively. Light sources 304*a* and 304*b* correspond to light source 104 in FIG. 1 and light beams 306*a* and 306*b* correspond to light beam 106 in FIG. 1.

As shown in FIG. 3, beads 330, 332, and 334 are strung on wire 342. Beads 330, 332, and 334 can comprise, for example, a translucent material, such as plastic or glass, or a reflective material, such as chrome. In the embodiment of the invention shown in FIG. 3, beads 330, 332, and 334 have a spherical shape. In other embodiments, beads 330, 332, and 334 can have various other shapes. As further shown in FIG. 3, beads 330, 332, and 334 have respective surfaces 336, 338, and 340. Although FIG. 3 depicts only three beads (i.e., beads 330, 332, and 334) for ease of illustration, additional beads may be included in device 300.

As shown in FIG. 3, liquid droplets, such as liquid droplets 306*a* and 306*b*, can travel down beads 330, 332, and 334 by traveling on the surface of one bead down to the surface of a neighboring bead using gravity. For example, liquid droplet 308*a* can travel on surface 336 of bead 330 to surface 338 of bead 332 and then to surface 340 of bead 334. As further shown in FIG. 3, light beams 306*a* and 306*b* are offset from surfaces 336, 338, and 340 so as to interact with and illuminate liquid droplets 308*a* and 308*b* as they travel down beads 330, 332, and 334. Moreover, light beams 306*a* and 306*b* can be either stationary or can rotate around beads 330, 332, and 334. Although FIG. 3 depicts only two light beams (i.e., light beams 306*a* and 306*b*) for ease of illustration, additional light beams may be included in device 300.

Figure 4:
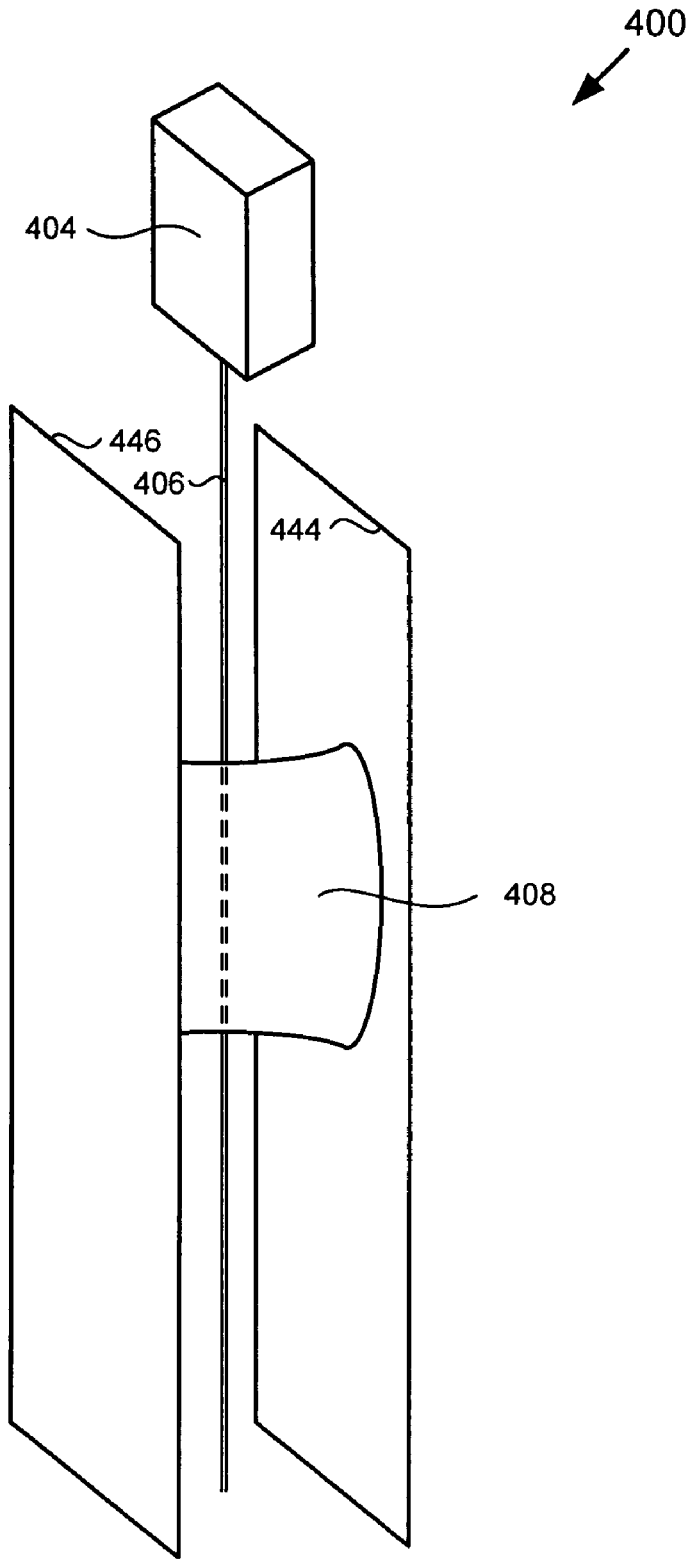
FIG. 4 illustrates an isometric view of a liquid droplet illumination device according to one embodiment of the present invention.

FIG. 4 shows an isometric view of liquid droplet illumination device 400 in accordance with one embodiment of the present invention. Device 400 in FIG. 4 includes surfaces 444 and 446, light source 404, light beam 406, and liquid droplet 408. In particular, light source 404 and light beam 406 in FIG. 4 correspond to light source 104 and light beam 106 in FIG. 1, respectively. As shown in FIG. 4, device 400 includes surfaces 444 and 446, which can each be, for example, a ribbon or strip of translucent material. In other embodiments, surfaces 444 and 446 can be a ribbon or strip of a reflective material, such as chrome colored graphic arts tape. Liquid droplet 408 can comprise distilled water or other types of liquids. Moreover, liquid droplet 408 can be colorless or can be made to have a color using, for example, various dyes and other methods known in the art.

As shown in FIG. 4, surfaces 444 and 446 can be positioned apart by a suitable distance such that liquid droplet 408 makes contact with surfaces 444 and 446 while traveling down (i.e., away from light source 404) between surfaces 444 and 446 due to gravity. Light beam 406 can be offset from surfaces 444 and 446 so as to interact with and illuminate liquid droplet 408 as it travels between surfaces 444 and 446. Thus, by positioning surfaces 444 and 446 such that liquid droplet 408 makes contact with surfaces 444 and 446, the path of liquid droplet 408 can be precisely controlled, thereby ensuring that liquid droplet 408 interacts with light beam 406 as it travels between surfaces 444 and 446. Although the embodiment of the invention shown in FIG. 4 includes one liquid droplet, i.e., liquid droplet 408, additional liquid droplets may be included.

Figure 5:
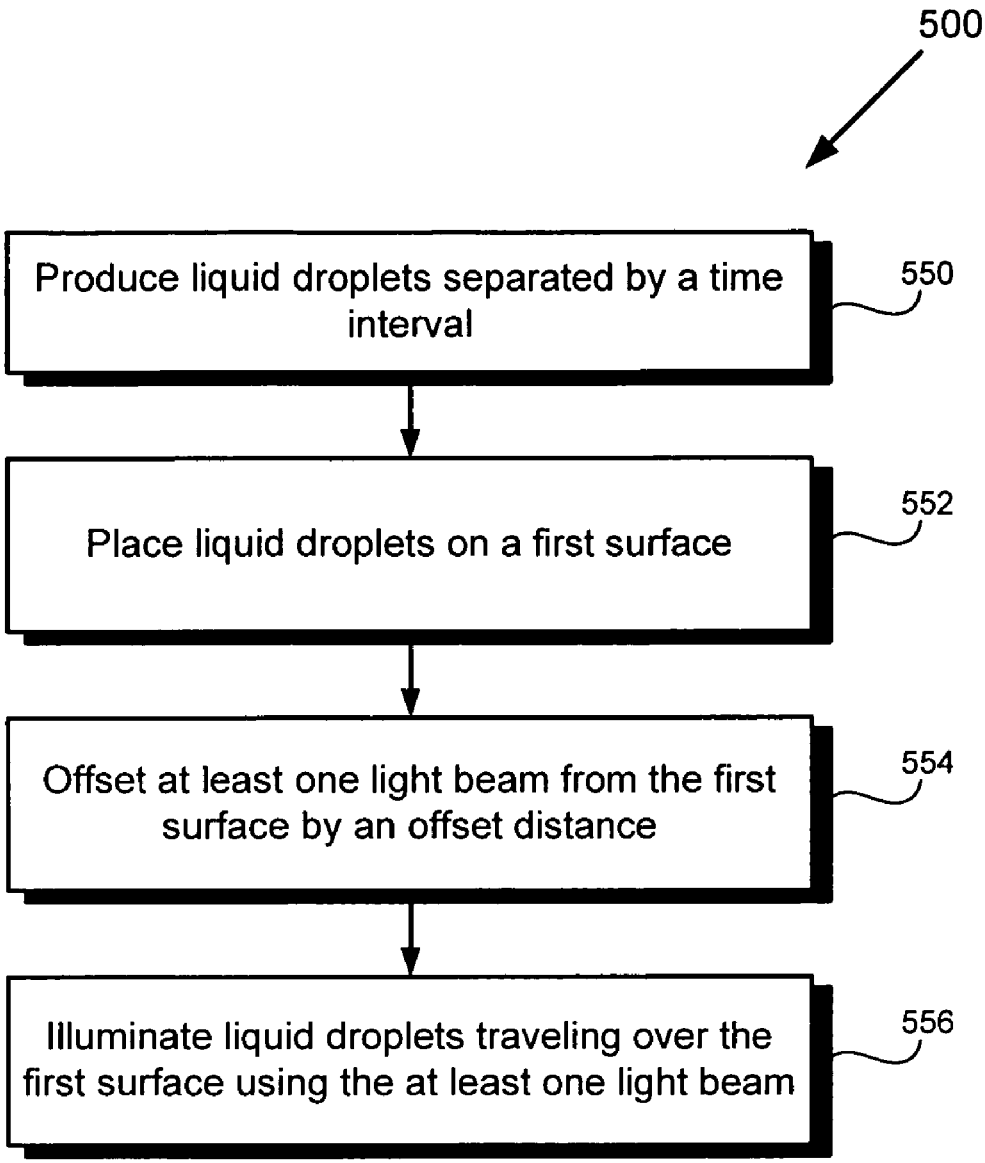
FIG. 5 shows a flowchart illustrating a method of illuminating a liquid droplet illumination, according to an embodiment of the present invention.

FIG. 5 shows a flowchart for performing method 500 for illuminating liquid droplets, in accordance with one embodiment of the present invention. As shown in FIG. 5 and with reference to FIG. 1A, at step 550 of flowchart 500, liquid droplets 108*a*, 108*b*, and 108*c* are produced such that the liquid droplets are separated by a time interval. At step 552, liquid droplets 108*a*, 108*b*, and 108*c* are placed on surface 102. At step 554, light beam 106 is offset from surface 102 by offset distance 118. At step 556, liquid droplets 108*a*, 108*b*, and 108*c* traveling on surface 102 are illuminated using light beam 106.

Thus, the present invention uses illuminated liquid droplets to produce interesting and attractive visual effects. The invention, therefore, can be included in various types of displays, such as light displays, at theme parks, amusement parks, or other places where such visual effects would be desirable. Since the liquid droplets can comprise distilled water, for example, the present invention can be advantageously easy to clean and maintain as compared to the conventional light display discussed above. Furthermore, by illuminating the liquid droplets of the invention using a laser beam, for example, the illuminated liquid droplets of the present invention can achieve high levels of contrast and can thus produce stunning results.

From the above description of the invention it is manifest that various techniques can be used for implementing the concepts of the present invention without departing from its scope. Moreover, while the invention has been described with specific reference to certain embodiments, a person of ordinary skill in the art would recognize that changes can be made in form and detail without departing from the spirit and the scope of the invention. For example, it is contemplated that the circuitry disclosed herein can be implemented in software, or vice versa. The described embodiments are to be considered in all respects as illustrative and not restrictive. It should also be understood that the invention is not limited to the particular embodiments described herein, but is capable of many rearrangements, modifications, and substitutions without departing from the scope of the invention.

What is claimed is:

1. A liquid droplet illumination device comprising:

at least one liquid droplet traveling on a first surface, wherein said liquid droplet has a thickness measured from said first surface;

a first light source configured to provide a first light beam having a first offset distance from said first surface, wherein said first offset distance is less than said thickness of said liquid droplet, such that said first light beam can travel through said liquid droplet so as to interact with said liquid droplet, thereby illuminating said liquid droplet.

2. The liquid droplet illumination device of claim 1 further comprising a second light source configured to provide a second light beam having a second offset distance from said first surface, wherein said second offset distance is less than said thickness of said liquid droplet, wherein said first surface defines first and second planes, said first light beam being oriented substantially parallel to said first plane and said second light beam being oriented substantially parallel to said second plane.

3. The liquid droplet illumination device of claim 1 further comprising a second surface, said first surface belonging to a first bead and said second surface belonging to a second bead, wherein said first bead and said second bead are configured such that said liquid droplet can travel from said first surface to said second surface.

4. The liquid droplet illumination device of claim 1 further comprising a second surface, said first surface being situated apart from said second surface such that said liquid droplet can contact said first and second surfaces while traveling between said first and second surfaces.

5. The liquid droplet illumination device of claim 1 wherein said first surface is an inner surface of a cylinder.

6. The liquid droplet illumination device of claim 1 wherein said first surface belongs to a translucent ribbon.

7. The liquid droplet illumination device of claim 1 wherein said first light beam is a laser beam.

8. The liquid droplet illumination device of claim 1 wherein said at least one liquid droplet comprises distilled water.

9. The liquid droplet illumination device of claim 1 further comprising a reservoir for storing a liquid.

10. The liquid droplet illumination device of claim 9 further comprising a pump, said pump circulating said liquid from said reservoir to said first surface.

11. A method of illuminating liquid droplets, said method comprising:

producing each of said liquid droplets separated by a time interval;

placing each of said liquid droplets on a first surface;

providing, a light beam having an offset distance from said first surface, wherein said offset distance is less than said thickness of said liquid droplet; and illuminating each of said liquid droplets traveling over said first surface using said light beam travelling through each of said liquid droplets.

12. The method of claim 11 wherein said offset distance is approximately one half of said thickness of each of said liquid droplets.

13. The method of claim 11 wherein said first surface belongs to a translucent ribbon.

14. The method of claim 11 wherein said light beam is a laser beam.

15. The method of claim 11 wherein said liquid droplets comprise distilled water.

16. The method of claim 11 further comprising collecting said liquid droplets in a reservoir.

17. The method of claim 16 wherein said producing each of said liquid droplets is performed by pumping liquid stored from said reservoir.

18. The method of claim 11 further comprising:

providing a second light beam having a second offset distance from said first surface, wherein said second offset distance is less than said thickness of said liquid droplet, and wherein said first surface defines first and second planes;

orienting said light beam substantially parallel to said first plane; and orienting said second light beam substantially parallel to said second plane.

19. The method of claim 11 wherein said first surface is provided by a plurality of beads.

* * * * *